US006763949B2

(12) United States Patent
Ohzeki et al.

(10) Patent No.: US 6,763,949 B2
(45) Date of Patent: Jul. 20, 2004

(54) WASTE RECOVERY STATION FOR BEACH CLEANER

(75) Inventors: Takashi Ohzeki, Saitama (JP); Yoshihiro Kimura, Saitama (JP); Yasuji Hashimoto, Saitama (JP); Yoshinobu Itani, Saitama (JP); Takashi Shinozaki, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 294 days.

(21) Appl. No.: 09/969,651

(22) Filed: Oct. 4, 2001

(65) Prior Publication Data

US 2002/0043373 A1 Apr. 18, 2002

(30) Foreign Application Priority Data

Oct. 6, 2000 (JP) ..... 2000-308492

(51) Int. Cl.[7] ..... B07B 1/49

(52) U.S. Cl. ..... 209/409; 209/372; 209/373; 209/412; 209/420; 209/421

(58) Field of Search ..... 209/370, 372, 209/373, 409, 410, 412, 420, 421

(56) References Cited

U.S. PATENT DOCUMENTS 4,608,725 A * 9/1986 Jackson ..... 15/3
4,824,285 A * 4/1989 Trierweiler ..... 405/17
5,197,211 A * 3/1993 Haug ..... 37/305
6,612,374 B2 * 9/2003 Ohzeki et al. ..... 171/65

FOREIGN PATENT DOCUMENTS

JP 2002356827 A * 12/2002 ..... E01H/12/00

* cited by examiner

*Primary Examiner*—Donald P. Walsh
*Assistant Examiner*—Joseph Rodriguez
(74) *Attorney, Agent, or Firm*—Birch, Stewart, Kolasch & Birch, LLP

(57) ABSTRACT

A waste recovery station for a beach cleaner for recovering waste raked up by a beach cleaner. A waste recovery station for a beach cleaner includes a pair of station members arranged in parallel with each other through a required spacing. Each station member is provided with a pair of support posts with a foot such as, for example, a circular or square flat plate fixed to a lower end of each support post and is also provided with a guide member fixed to upper ends of the support posts. In the guide member, a longitudinally intermediate portion is formed as a horizontal portion and front and rear end sides are formed as slant portions and are bent downwardly at an obtuse angle. The beach cleaner A is lifted by the guide members while passing between the station members, whereby waste caught on rakes is allowed to drop onto the sand.

20 Claims, 4 Drawing Sheets

WASTE RECOVERY STATION FOR BEACH CLEANER

CROSS-REFERENCE TO RELATED APPLICATIONS

The present application claims priority under 35 USC 119 to Japanese Patent Application No. 2000-308492 filed on Oct. 6, 2000 the entire contents thereof is hereby incorporated by reference.

BACKGROUND OF THE INVENTION

1. Field of the Invention

The present invention relates to a waste recovery station for recovering waste from a beach cleaner after the waste is raked up by a beach cleaner for cleaning a sandy beach such as a bathing beach.

2. Description of Background Art

In a sandy beach such as a bathing beach or a dunes waste such as fishing net fragments, vinyl strings, paper scraps, wood pieces such as driftwood, empty cans, and cigarette ends are scattered along the beach. If the waste is left on the beach, the sandy beach becomes more and more dirt. In addition, sea bathers may be accidentally injured. Thus, for example, just before the sea bathing season a clean-up by using a beach cleaner occurs for recovering waste from the sandy beach.

As a conventional beach cleaner there has been adopted a each cleaner of the type in which waste present on or in sand is scooped up together with sand by means of a scooping machine provided in a front portion of a self-traveling type frame and the waste and the sand are separated from each other while being conveyed by a belt conveyor, the sand is allowed to drop onto the sandy beach from which it has been scooped up, while the waste is recovered into a basket or the like. However, the beach cleaner having a self-traveling frame intends to complete the recovery of waste by making a round of the sandy beach at a low speed throughout the entire traversal of the sandy beach. Such a beach cleaner requires a long cleaning time and is not efficient; besides, since the entire structure is complicated and is large in size, the beach cleaner is heavy and maintenance and servicing is complicated and require a long time. Further, the manufacturing cost becomes high.

SUMMARY AND OBJECTS OF THE INVENTION

In view of the above-mentioned points the present invention is directed to a beach cleaner A of a simple type that is adapted to travel on a sandy beach at a high speed while being towed by a self-traveling vehicle R, such as indicated with a dash-double dot line in FIGS. 1 to 3.

The beach cleaner A comprises a frame 3 formed in a square hurdle shape in plan view and in a sled shape in side view with front and rear sides that are inclined so as to be higher toward both ends. A plurality of longitudinal members 2 are arranged through appropriate spacings and are fixed inside an outer frame 1. A plurality of rakes 4 are fixed at appropriate intervals in the longitudinal direction to lower surfaces of horizontal portions 2*a* of the longitudinal members 2 of the frame 3 and are arranged in a zigzag fashion in plan view while being displaced in a longitudinal phase between adjacent longitudinal members 2. A scraper 5 positioned on the front side of the horizontal portions 2*a* in the frame 3 and is fixed perpendicularly to and projecting downward from both-side longitudinal frames 1*a* of the outer frame 1 and the longitudinal members 2. The scraper 5 is inclined downwardly on a front side of the scraper 5. A pair of front engaging members 6 and a pair of rear engaging members 6 projecting outwardly from the longitudinal frames 1*a* of the outer frame 1. A plurality of rotary blades 7 are supported by a support shaft which is fixed to the rear end side of the frame 3. The rotary blades 7 are adapted to rotate freely between adjacent longitudinal members 3. A waste catch net 8 is removably stretched on an upper surface of the frame 3.

For cleaning a sandy beach, a chain or wire J for example, which is anchored to the self-traveling vehicle R is connected to hooks 9 fixed to a pair of longitudinal members 2 which are located at transversely symmetric positions on the front end side of the frame 3. The self-traveling vehicle R is allowed to travel longitudinally and transversely in a required cleaning area of the sandy beach, whereby waste present on and in the sand are caught on the rakes 4 of the frame 3 and are collected in an appropriate place.

Although the above beach cleaner A is of a simple type and can easily be moved to the waste collection place with waste caught on the rakes 4 to permit recovery of the waste, it is necessary to remove the waste manually from the rakes 4 every time the waste is to be recovered. At this time, it is necessary to lift the frame 3 to let the waste drop onto the sand. Thus, the work for removing waste from the beach cleaner A requires much labor and time and is therefore inefficient. For this reason it has been desired to develop an apparatus capable of removing waste easily from the beach cleaner A.

The present invention has been accomplished in view of the above-mentioned circumstances and it is an object of the invention to provide a waste recovery station for a beach cleaner that is simple in structure and capable of easily recovering waste from a beach cleaner after raked up by the beach cleaner.

For solving the above-mentioned problems the present invention is characterized by the following points.

The waste recovery station for a beach cleaner according to the present invention includes a pair of station members, the station members include guide members and support posts, the support posts each having a foot at a lower end thereof. The guide members are fixed onto an upper end of the support posts and being each are formed so as to be rectilinear in plan view and so that in side view a longitudinally central portion thereof is a horizontal portion and both end sides thereof are bent downwardly at an obtuse angle to form slant portions, the pair of station members are installed by arranging the guide members in parallel with each other through a predetermined spacing in a plan view and by grounding the foot of each support post.

In this waste recovery station for a beach cleaner, when a self-traveling vehicle passes between the station members at a low speed while towing a beach cleaner with waste caught on the rakes, engaging members provided on a frame of the beach cleaner come into engagement with the slant portions of the guide members, so that the beach cleaner is lifted gradually along the rear slant portion, becomes horizontal at the longitudinal central portions of the station members and the rakes secure to a lower surface of the frame are spaced a suitable distance upwardly from an upper surface of the sand. At this instant, the waste caught on the rakes of the beach cleaner drop naturally onto the sand in the waste recovery station. When the waste is recovered in the waste recovery station, the beach cleaner is moved away from the same station. With this movement, the engaging members come into engagement with the front slant portions of the station members, the beach cleaner moves down gradually along the slant portion and the rakes are brought into contact with the sand.

According to this waste recovery station for a beach cleaner, as the beach cleaner passes between the station members, it is lifted easily to a required height above the sand and the rakes thereof are spaced sufficiently from the upper surface of the sand, so that the waste caught on the rakes is allowed to drop naturally and is recovered within the waste recovery station easily.

Besides, since the waste recovery station is simply composed of support posts and guide members having slant portions and fixed onto the support posts, it is simple in structure and easy to manufacture.

In the present invention, a waste recovery station for a beach cleaner wherein the guide members are each divided at an approximately intermediate portion in the longitudinal direction thereof and the divided intermediate portions of each guide member are connected together disconnectably.

According to this construction, since constituent members of the waste recovery station are each divided into a plurality of members, individually divided members are smaller in size and hence easier to handle and transport.

In the present invention a waste recovery station is provided for a beach cleaner wherein the station members are connected with each other through a connecting member mounted between the lower end or feet of the support posts.

According to this construction, the station members are grounded while the spacing thereof is set constant and this state is maintained stably, so that the beach cleaner can be lifted safely.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

A waste recovery station for a beach cleaner according to an embodiment of the present invention will be described below with reference to FIGS. 1 to 3.

Figure 1:
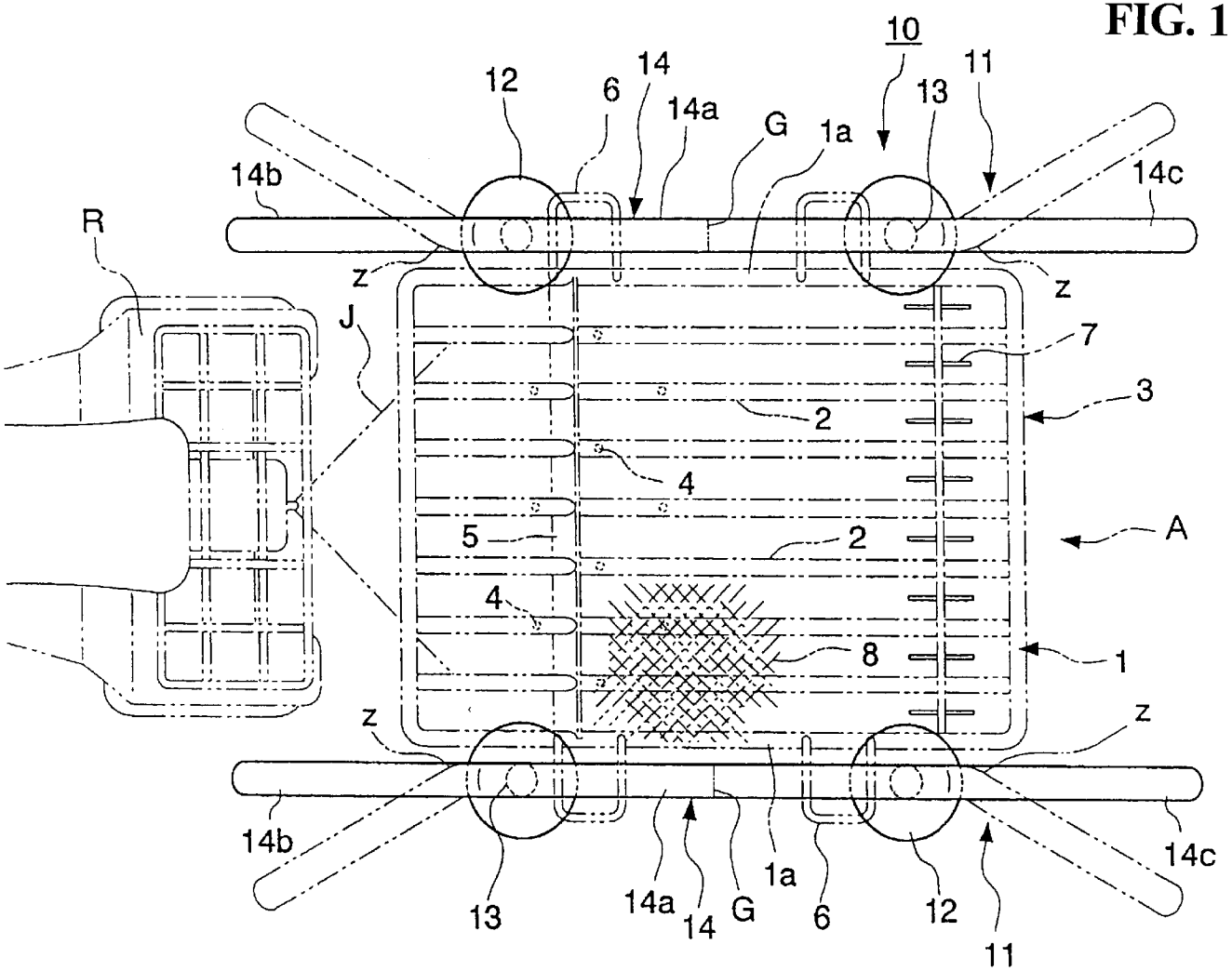
FIG. 1 is a plan view showing a waste recovery station for a beach cleaner according to an embodiment of the present invention.
Figure 2:
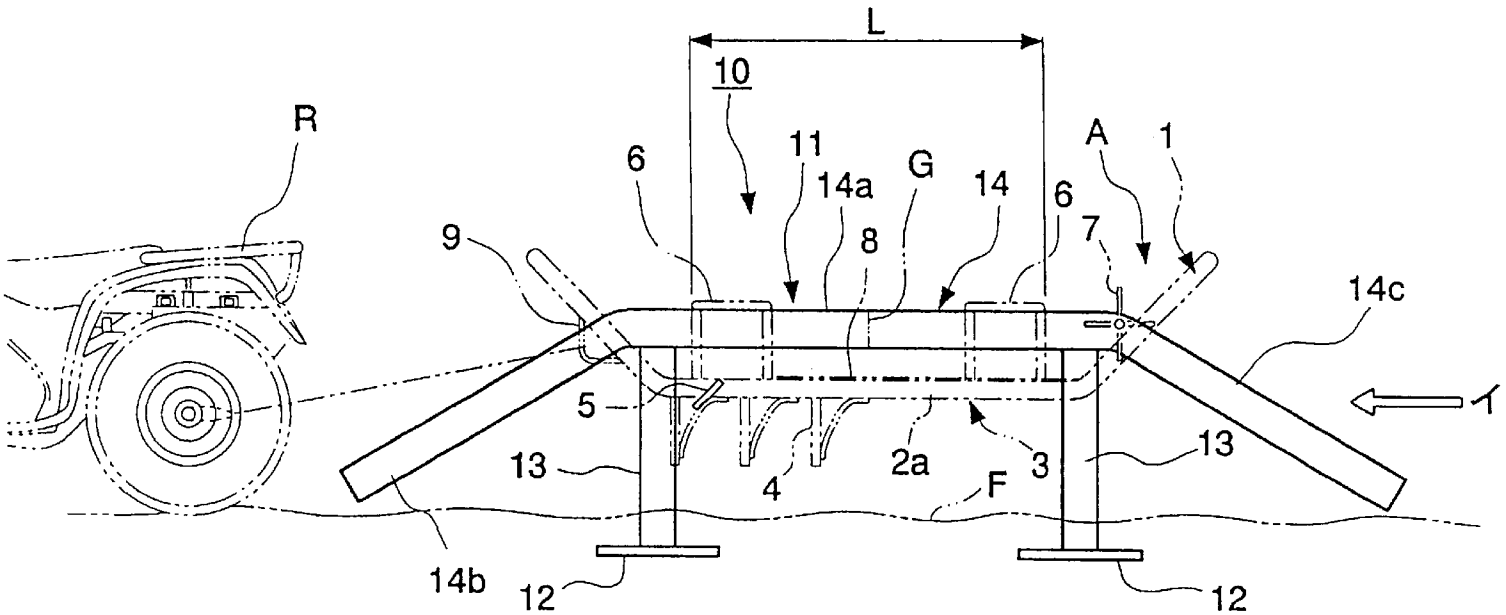
FIG. 2 is a side view thereof.
Figure 3:
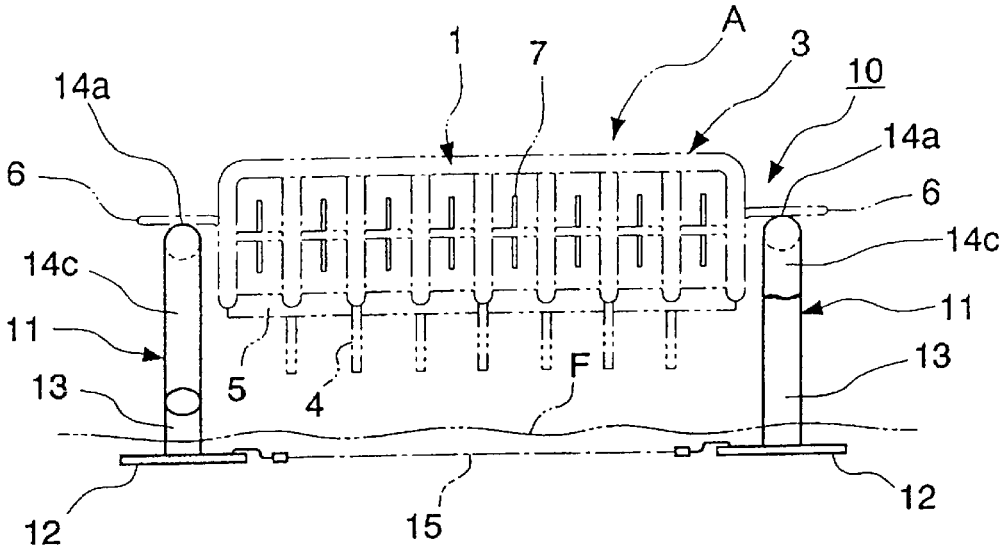
FIG. 3 is a front view thereof.

In FIGS. 1–3, a waste recovery station 10 is provided for a beach cleaner. The waste recovery station 10 includes a pair of station members 11. Each station member 11 is provided with a pair of support posts 13 each having a foot 12 fixed to a lower end thereof. The foot 12 includes a circular or square flat plate or the like. A guide member 14 is fixed to an upper end of the support posts 13. Each station member 11 is formed in a symmetric shape longitudinally (right and left in FIG. 1). A longitudinally intermediate portion of each guide member 14 is formed as a horizontal portion 14*a* and front and rear end sides thereof are bent downwardly at an obtuse angle to form slant portions 14*b* and 14*c*.

The support posts 13 and the guide members 14 can be constructed by rods or pipes.

The foot 12 of each support post 13 may be constructed of a flat plate that is preferable because the support posts 13 are held upright stably by the weight of the sand when they are buried in the sand. However, the present invention is not limited to a flat plate. Rods or the like may be disposed radially around each support post 13. No special limitation is placed on the shape of the foot 12 insofar as the component used as the foot 12 can support the associated support post 13 upright when it is buried in the sand or is installed on the sand.

The length of the horizontal portion 14*a* of each guide member 14 is set larger by a predetermined length than the spacing L between a pair of engaging members 6 provided on each side portion of the frame 3 in the beach cleaner A.

The inclination angle of the slant portions 14*b* and 14*c* of each guide member 14 is not specially limited if only the slant portions are bent at an obtuse angle from the horizontal portion. But it is preferable to set the inclination angle at 15° to 30° in terms of the angle relative to an upper surface F of the sand so that the engaging members 6 can slide on the slant portion 14*c* with reduced resistance when the beach cleaner A moves onto the guide members 14 in the waste recovery station. Also as to the slant portion 14*b*, it is preferable to set its inclination angle at about 30° as the angle to the sand upper surface F so that the beach cleaner A can move down smoothly.

A vertical position of the horizontal portions 14*a* of each guide members 14 is set at a position at which rakes 4 of the beach cleaner A are sufficiently spaced apart from the upper surface F of the sand when the beach cleaner is moved onto the horizontal portions 14*a*.

The horizontal portions 14*a* of the guide members 14 are not always required to be exactly horizontal. The horizontal portions 14*a* may be somewhat inclined insofar as the rakes 4 of the beach cleaner A are spaced an appropriate height away from the sand upper surface when the beach cleaner A gets on the horizontal portions 14*a*.

Further, in each guide member 14, gently inclined extending portions may be formed at ends of the slant portions 14*b* and 14*c* as necessary.

The station members 11 are installed on a sandy soil such as a sandy bathing beach or a dunes in such a manner that the guide members 14 are parallel to each other in plan and that the support posts 13 stand upright with the feet 12 buried shallowly in the sand. In this way there is constituted the waste recovery station 10 for a beach cleaner. The spacing between the station members 11 is set at a distance in such a manner as that the self-traveling vehicle R which tows the beach cleaner A and the frame 3 of the beach cleaner A can pass between the station members and that the engaging members 6 of the beach cleaner can engage the guide members 14 to a satisfactory extent even if the beach cleaner A is somewhat dislocated to the right or left.

The following description is now provided about the operation of the waste recovery station 10 for a beach cleaner constructed as above.

After the waste recovery station 10 is installed on, for example, a sandy bathing beach, the beach cleaner A is connected through the chain J or the like to the self-traveling vehicle R such as a buggy, then the beach cleaner A is allowed to move on the sand while being towed by the self-traveling vehicle R.

As a result, waste present on the sand or buried shallowly in the sand of the sandy beach are caught on the rakes 4. When the amount of the waste thus caught has reached a certain amount, the beach cleaner A is allowed to travel up to the waste recovery station 10 and the self-traveling vehicle R is allowed to pass forward at a low speed between the station members 11.

When the self-traveling vehicle R tows the beach cleaner A with waste caught on the rakes 4 and passes between the station members 11 and moves forward, the engaging members 6 provided on the frame 3 of the beach cleaner A come into engagement with the slant portions 14*c* located on the rear side (in the traveling direction of the self-traveling vehicle R) of the guide members 14 of the station members 11, whereby the beach cleaner A is guided along the slant portions 14*c* and is gradually lifted successively from the front side thereof. In this way the beach cleaner A is moved smoothly up to longitudinally central portions of the station members 11. At this time, the beach cleaner A assumes a horizontal state and the rakes 4, which project downwardly from a lower surface of the frame 3, are spaced a predetermined distance away from the sand upper surface F. In this state the travel of the beach cleaner A is stopped.

In the meantime, the waste caught on the rakes 4 of the beach cleaner A drops naturally onto the upper surface F of the sand in the waste recovery station 10. Waste which fails to drop naturally can be removed by using a suitable scraping means.

After the recovery of the waste in the waste recovery station 10, the beach cleaner A is further moved forward away from the waste recovery station 10 and enters into the next waste recovery work. When the beach cleaner A leaves the waste recovery station 10, the engaging members 6 come into engagement with the front slant portions 14*b* of the station members 14, the beach cleaner A moves down gradually along the slant portions 14*b* and the rakes 4 thereof come into contact with the upper surface of the sand smoothly.

According to the waste recovery station 10 for a beach cleaner constructed as above, by allowing the beach cleaner A to pass between the station members 11, the beach cleaner can be easily lifted up to a required height above the sand, permitting the rakes 4 to be sufficiently spaced from the upper surface of the sand, so that the waste caught on the rakes 4 can be allowed to drop naturally and be recovered within the waste recovery station 10 easily.

When waste is to be removed and recovered from the beach cleaner A, it is not necessary to perform the work such as lifting the beach cleaner A by manual labor and scraping off waste. Therefore, the work of recovering the waste requires less labor and time.

Besides, since the waste recovery station 10 is constructed simply by fixing the guide members 14 having slant portions 14*b* and 14*c* onto the support posts 13, it is simple in structure and can be fabricated inexpensively.

When the waste recovery station 10 for a beach cleaner is not assembled, the station members 14 may be utilized as fences for delimiting the surroundings of a seaside cottage or any other area.

Figure 4:
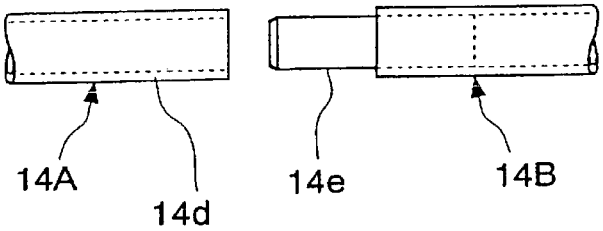
FIG. 4 is a side view showing the structure of a guide member connecting portion.

Although in the above embodiment the guide members 14 are each constituted by a single member, there may be adopted such a construction as shown in FIG. 4, in which each guide member 14 is divided into front and rear portions in a longitudinally intermediate position (see a chain line G in FIG. 2), that is, in an intermediate position between a pair of support posts 13, a tubular portion 14*d* is formed in one divided piece 14A of the guide member 14 (if the guide member 14 is a pipe, the pipe is utilized as it is), while a shaft portion 14*e* is formed in the other divided piece 14B, and both are disconnectably fitted together. This construction is convenient because the components of each guide member 14 can be reduced in size and the waste recovery station can be handled and transported easily at the time of installation thereof.

Although in the above embodiment the station members 11 are installed on sand at an installation place by grounding the support posts 13 independently and spaced the support posts 13 a predetermined distance from each other, the present invention is not limited to this construction. There may be adopted a construction wherein the lower ends or feet 12 of the support posts 13 are disconnectably or integrally connected with each other by means of a connecting member 15 (see FIG. 3) which defines the spacing between the station members 11. The connecting member 15 may be a rod, a plate-like member, a rope member, e.g., chain or wire, or a sheet member.

According to this construction, the station members 11 are grounded while the spacing between the two is set constant by the aforesaid connecting member, and this state is maintained stably, permitting the beach cleaner A to be lifted safely.

Although in the above embodiment the horizontal portion 14*a* and the slant portions 14*b*, 14*c* of each station member 11 are formed in a straight line as a whole so as to be parallel with like components of the other station member in plan, end sides of the slant portions 14*b* and 14*c* may be bent outwardly in approximately V shape at bending portions "z," as indicated with dash-double dot lines in FIG. 1. In this case, a side view is the same as above. This construction permits the beach cleaner A to get onto and down from the waste recovery station 10 more easily.

Figure 5:
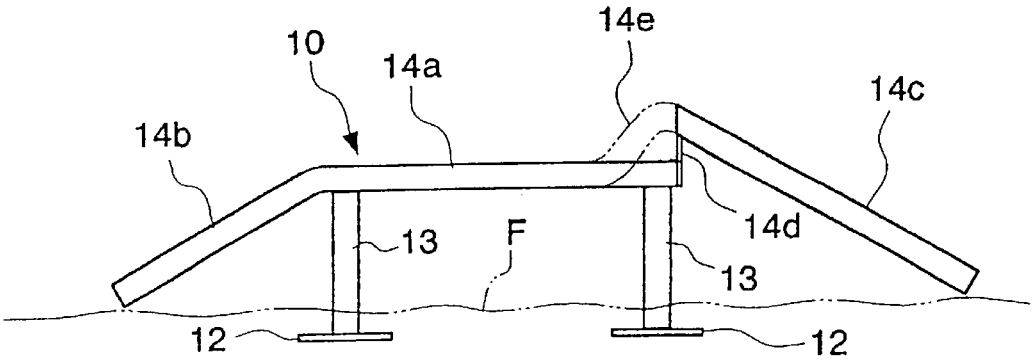
FIG. 5 is a side view showing a waste recovery station for a beach cleaner according to another embodiment of the present invention.

Although in the above embodiment the connection between the rear slant portion 14*c* and the horizontal portion 14*a* in each station member 11 is a smooth connection free of any difference in height in side view, there may be adopted such a construction as shown in FIG. 5 in which an end portion on the horizontal portion 14*a* side of the slant portion 14*c* is higher than the horizontal portion 14*a*, with a difference in height provided between the end portion and the horizontal portion 14*a* as indicated at 14*d*, an upwardly convex curvilinear portion 14*e* may be formed as indicated with a chain line in FIG. 5. In this case, when the beach cleaner A enters the waste recovery station 10 at a certain speed, a shock occurs in a lower position due to a parabolic motion at the time of landing on the horizontal portion 14*a* from the slant portion 14*c*, thus facilitating a drop of the waste caught on the rakes 4.

Figure 6:
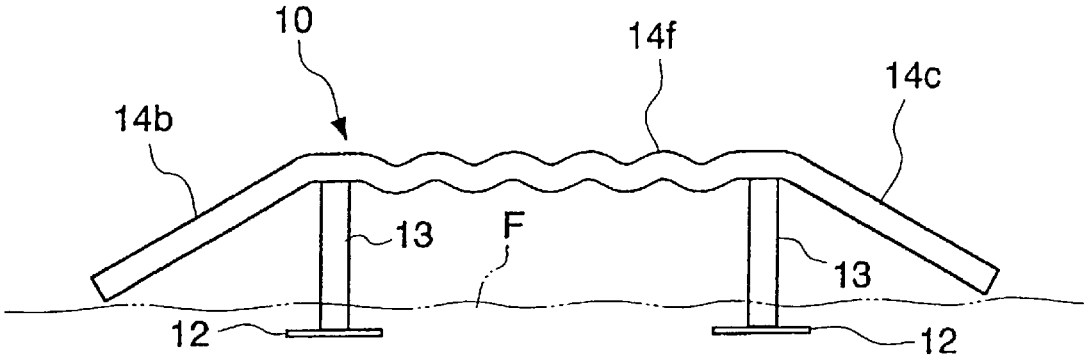
FIG. 6 is a side view showing a waste recovery station for a beach cleaner according to a further embodiment of the present invention.

Further, as shown in FIG. 6, the horizontal portion 14*a* of each station member 11 may be formed as a corrugated portion 14*f* which is uneven vertically in side view, causing a shock to be generated when the beach cleaner A moves on the corrugated portion 14*f*, whereby it is possible to let the waste caught on the rakes 4 drop easily.

As set forth above, the following outstanding effects are attained by the present invention.

According to the waste recovery station for a beach cleaner of the present invention, by allowing the beach cleaner to pass between the station members, the beach cleaner can be lifted easily up to a required height above the sand and the rakes can be spaced a sufficient distance from the upper surface of the sand, whereby the waste caught on the rakes can be allowed to drop naturally and thus can be recovered easily within the waste recovery station.

Therefore, when waste is to be removed and recovered from the beach cleaner, it is not necessary to lift the beach cleaner by a manual operation and scrape off the waste, that is, it is possible to save labor and recover waste in a short time.

Since the waste recovery station is constructed simply by fixing guide members having slant portions onto support posts, it is simple in structure and can be fabricated easily and inexpensively.

According to the waste recovery station for a beach cleaner of the present invention, since the guide members include members of the waste recovery station that are each divided into a plurality of members, the individual divided members become smaller in size and are thus easier to handle and transport.

According to the waste recovery station for a beach cleaner of the present invention, the station members can be grounded while the spacing thereof is set constant, and this state can be maintained stably, thus permitting the beach cleaner to be lifted safely.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A waste recovery station for a beach cleaner comprising:

a pair of station members, said station members include guide members and support posts;

said support posts each include a foot at a lower end thereof;

said guide members are fixed onto upper ends of said support posts and said guide members are each formed to be rectilinear in plan view and in a side view a longitudinally central portion thereof is a horizontal portion and both end sides thereof are bent downwardly at an obtuse angle to form slant portions, said pair of station members are installed by arranging said guide members substantially in parallel with each other through a predetermined spacing in plan view and by grounding said foot of each said support post, wherein said beach cleaner passes relative to said guide members for enabling discharge of waste directly from the beach cleaner.

2. The waste recovery station for a beach cleaner according to claim 1, wherein said guide members are each divided at an approximately intermediate portion in the longitudinal direction thereof and the divided intermediate portions of each said guide member are disconnectably connected together.

3. The waste recovery station for a beach cleaner according to claim 1, wherein said station members are connected with each other through a connecting member mounted between the lower ends or feet of said support posts.

4. The waste recovery station for a beach cleaner according to claim 2, wherein said station members are connected with each other through a connecting member mounted between the lower ends or feet of said support posts.

5. The waste recovery station for a beach cleaner according to claim 1, wherein said guide member includes a first section that is raised upwardly relative to said longitudinal central portion for imparting a shocking action to an object that is moved upwardly on said end sides and then is dropped downwardly unto said longitudinal central portion.

6. The waste recovery station for a beach cleaner according to claim 1, wherein said guide member includes a corrugated portion for imparting a shocking action to an object that is moved along said longitudinal central portion.

7. The waste recovery station for a beach cleaner according to claim 1, wherein said longitudinal central portion is of a predetermined length for accommodating an object that is moved upwardly on said end sides and for spacing said object a predetermined distance above a ground surface.

8. A waste recovery station for a beach cleaner comprising:

a first guide member including a first end and a distal end;

a second guide member spaced a predetermined distance relative to said first guide member, said second guide member including a first end and a distal end;

a first support post mounted on the first end of said first guide member;

a second support post mounted on the distal end of said first guide member;

a third support post mounted on the first end of said second guide member;

a fourth post mounted on the distal end of said second guide member;

said first and second guide members forming station members;

said first, second, third and fourth support post being, respectively, fixed to said guide members for mounting said guide members a predetermined distance relative to a ground surface;

a first inclined portion being mounted to the first end of said first guide member, said first inclined portion being bent downwardly at an obtuse angle to form a slant portion;

a second inclined portion being mounted to the distal end of said first guide member, said second inclined portion being bent downwardly at an obtuse angle to form a slant portion;

a third inclined portion being mounted to the first end of said second guide member, said third inclined portion being bent downwardly at an obtuse angle to form a slant portion; and a fourth inclined portion being mounted to the distal end of said second guide member, said second inclined portion being bent downwardly at an obtuse angle to form a slant portion;

said station members are installed by arranging said guide members substantially in parallel with each other through a predetermined spacing in plan view and by grounding each said support post, wherein said beach cleaner passes relative to said guide members for enabling discharge of waste directly from the beach cleaner.

9. The waste recovery station for a beach cleaner according to claim 8, wherein said guide members are each divided at an approximately intermediate portion in a longitudinal direction thereof and the divided intermediate portions of each said guide member are disconnectably connected together.

10. The waste recovery station for a beach cleaner according to claim 8, wherein said station members are connected with each other through a connecting member mounted between the lower ends of said support posts.

11. The waste recovery station for a beach cleaner according to claim 9, wherein said station members are connected with each other through a connecting member mounted between the lower ends of said support posts.

12. The waste recovery station for a beach cleaner according to claim 8, wherein said guide member includes a first section that is raised upwardly relative to said guide member for imparting a shocking action to an object that is moved upwardly on said end sides and then is dropped downwardly unto said guide member.

13. The waste recovery station for a beach cleaner according to claim 8, wherein said guide member includes a corrugated portion for imparting a shocking action to an object that is moved along said longitudinal central portion.

14. The waste recovery station for a beach cleaner according to claim 8, wherein said guide member is of a predetermined length for accommodating an object that is moved upwardly on said end sides and for spacing said object a predetermined distance above a ground surface.

15. A waste recovery station for a beach cleaner comprising:

a pair of station members, said station members include guide members and support posts;

said support posts each include a foot at a lower end thereof;

said guide members are fixed onto upper ends of said support posts and said guide members are each formed to be rectilinear in plan view and in a side view a longitudinally central portion thereof is a horizontal portion and both end sides thereof are bent downwardly at an obtuse angle to form slant portions, said pair of station members are installed by arranging said guide members substantially in parallel with each other through a predetermined spacing in plan view and by grounding said foot of each said support post, at least one of said guide members includes a corrugated portion for imparting a shocking action to an object that is moved along said longitudinal central portion.

16. The waste recovery station for a beach cleaner according to claim 15, wherein said guide members are each divided at an approximately intermediate portion in the longitudinal direction thereof and the divided intermediate portions of each said guide member are disconnectably connected together.

17. The waste recovery station for a beach cleaner according to claim 15, wherein said station members are connected with each other through a connecting member mounted between the lower ends or feet of said support posts.

18. The waste recovery station for a beach cleaner according to claim 16, wherein said station members are connected with each other through a connecting member mounted between the lower ends or feet of said support posts.

19. The waste recovery station for a beach cleaner according to claim 15, wherein said at least one guide member includes a first section that is raised upwardly relative to said longitudinal central portion for imparting a shocking action to an object that is moved upwardly on said end sides and then is dropped downwardly unto said longitudinal central portion.

20. The waste recovery station for a beach cleaner according to claim 15, wherein said longitudinal central portion is of a predetermined length for accommodating an object that is moved upwardly on said end sides and for spacing said object a predetermined distance above a ground surface.

* * * * *